US010871025B2

(12) United States Patent
Gill et al.

(10) Patent No.: US 10,871,025 B2
(45) **Date of Patent: *Dec. 22, 2020**

(54) TWO IN ONE DOOR HANGER BRACKET

(71) Applicant: Express Products, Inc., Grandville, MI (US)

(72) Inventors: Ryan L. Gill, Wyoming, MI (US); Michael J. Gill, Grand Rapids, MI (US); Dennis G. Gill, Grand Rapids, MI (US)

(73) Assignee: Express Products, Inc., Grandville, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/417,203

(22) Filed: May 20, 2019

(65) Prior Publication Data

US 2020/0095821 A1 Mar. 26, 2020

Related U.S. Application Data

(63) Continuation-in-part of application No. 16/138,502, filed on Sep. 21, 2018.

(51) Int. Cl.
*E06B 1/60* (2006.01)
*E06B 1/52* (2006.01)

(52) U.S. Cl.
CPC ..... *E06B 1/6015* (2013.01); *E06B 1/52* (2013.01)

(58) Field of Classification Search
CPC ..... E06B 1/6007; E06B 1/60; E06B 1/6015; E04F 21/0015
See application file for complete search history.

(56) References Cited

U.S. PATENT DOCUMENTS 4,014,146 A * 3/1977 DiMascio ..... E06B 1/6015 52/211
4,283,034 A * 8/1981 Sheehan ..... A47H 1/102 248/263
5,615,850 A * 4/1997 Cloninger ..... F16L 3/22 211/26
7,716,886 B2 * 5/2010 Gordon ..... E06B 1/60 206/325
7,882,662 B2 * 2/2011 Root ..... E06B 1/6015 49/380
8,333,359 B2 * 12/2012 Gordon ..... E06B 1/6015 248/223.21
9,157,619 B1 * 10/2015 Newton ..... F21V 21/116
(Continued)

FOREIGN PATENT DOCUMENTS

EP 1396602 A1 * 3/2004 ..... E06B 1/6015

*Primary Examiner* — Adriana Figueroa
(74) *Attorney, Agent, or Firm* — Mitchell Intellectual Property Law, PLLC

(57) ABSTRACT

A door assembly, a hanger bracket therefor and the method of using the bracket to hang the door jamb assembly, in which the door hanger bracket has an elongated body configured to provide a wall mounting tab at each end, such that said bracket can be secured to a door jamb as a unitary bracket and provide a wall mounting tab on each wall at each side of the jamb. The bracket also includes a break line such that it can be broken in two and used either on two different jambs or two different locations on the same side of a single jamb or can be located on opposite sides of the same jamb, where the jamb is too wide for the unitary bracket.

6 Claims, 10 Drawing Sheets

(56) References Cited

U.S. PATENT DOCUMENTS

| | | | | |
|---|---|---|---|---|
| 10,024,067 | B2 * | 7/2018 | Gordon | E04F 21/0015 |
| 2001/0010167 | A1 * | 8/2001 | Leek | B21D 5/0209 72/379.2 |
| 2008/0054137 | A1 * | 3/2008 | Poulin | E06B 1/6015 248/208 |
| 2019/0127971 | A1 * | 5/2019 | Stauffer | E04B 1/4178 |

* cited by examiner

TWO IN ONE DOOR HANGER BRACKET

CLAIM OF PRIORITY

This application claims priority to and is a continuation in part of U.S. patent application Ser. No. 16/138,502 filed Sep. 21, 2018 entitled DOOR HANGER BRACKET.

FIELD OF THE INVENTION

The invention relates to door assembly hanger brackets and their use in combination with door assemblies to hang the door assemblies.

BACKGROUND ART

Historically, many types of door assemblies are utilized in various environments, including, for example, residential, commercial and office interiors. Although numerous types of doors are well known in the art, a typical door assembly may include a door frame or jamb, as well as the door itself. The door frame can include what is characterized as a header jamb assembly for the top of the doorway opening within a wall or the like. Latch and hinge jamb sections are also utilized, for the sides of the doorway opening in the wall. With these types of configurations, it is necessary to be able to accommodate for variations in the thickness and alignment of the wall within which the door is to be located. Accordingly, it is necessary for the door frame to be adjustably positioned so to accommodate these wall thicknesses and variations in alignment. It is not uncommon for door assemblies today to be packaged as a combination of a "pre-hung" door which is hinged to a prefabricated jamb, where the door and the jamb are sold as a single unit. As earlier described, the door jamb is installed within what is often a "rough" opening, framed with studs edged by liners. In the prior art, it is known to install the door assembly by placing the door jamb in the rough opening, and then plumbing the door jamb.

The prior art includes several door hanger brackets of different designs, intended to assist in mounting such "pre-hung" door assemblies in a wall opening. One such bracket is an elongated rectangular flat plate made of manually formable metal. It includes jamb mounting holes, and a pair of holes toward each end of the flat plate, located laterally adjacent one another to facilitate bending each end of the flat plate into a wall mounting flange. Located in each wall mounting flange portion is an edge notch to facilitate alignment with a plumb line on the wall, and a mounting slot to facilitate mounting to the wall. The flat plate is located on and attached to the door jamb with the end portions extending beyond the opposite edges of the jamb. The door assembly is positioned in a wall opening, and first one and then the other of the extending end portions are manually bent into a wall mounting tab for attaching to the opposite sides of the wall.

Horak, Jr. U.S. Pat. No. 6,293,061 issued Sep. 25, 2001 describes a system and method for installing a jamb within a wall having an inward face facing inwardly toward the door, and a peripheral face facing away from the door. A spaced apart series of clips are utilized, with each clip having an external arm and a transverse internal arm. The external arm is adapted for longitudinally directed and surficial attachment to the wall. The internal arm of each clip is separately attached along the peripheral face of the jamb. With the jamb positioned in the wall, the jamb is plumbed and the external arms of the clips are attached to the wall longitudinally. Plumb means are utilized for determining whether the jamb is plumb, with the plumb means having indicia on the external arm of the clip for alignment with a leveling tool. A deformation is included on the external arm, against which the leveling tool can be aligned.

Tait, et. al., U.S. Pat. No. 5,119,609 issued Jun. 9, 1992 describes the use of a plastic nailing fin for use with a window or door assembly. The nailing fin can be folded from a stored position in front, to a working position along the side. The fin runs the full length and width of a window frame or door frame. Installation requires use of a substantial number of nails.

Murphy, Jr., U.S. Pat. No. 5,692,350 issued Dec. 2, 1997 is an example of an apparatus and method for door leveling utilizing shims. Specifically, the Murphy, Jr, apparatus includes a spring shim and an anchor. The spring shim has a pressure foot at each of two ends for engaging either the wall or the closure, and an intermediate portion having a central aperture for receiving the anchor. The door closure is leveled and plumbed within the opening, by attaching a series of spring shims at spaced locations around the closure. The closure and attached spring shims are then positioned in the opening, followed by the engaging and penetrating of the anchors into the wall.

Kidd, U.S. Pat. No. 5,771,644 issued Jun. 30, 1998 discloses an anchoring clip for the installation of a door in stud or masonry walls. The clip is directed toward anchoring of the door, rather than accurate plumbing of the door assembly.

Lovgren, U.S. Pat. No. 4,840,002 issued Jun. 20, 1989 discloses a clip having one arm embedded in the edge of a door jamb, with another arm acting as a backer for the jamb. The leg of the clip is screwed into the edge of the jamb, and into a steel support stud. By screwing into the edge of the jamb and by embedding an arm into that edge, an obstruction is produced which hampers attaching trim around the doorjamb. Lovgren discloses the use of specialized tongue flanges which are designed to fit into customized bores in the wood trim. In accordance with the foregoing, specialized trims must be utilized, and the Lovgren arrangement does not appear to be capable of use with standard door trims.

Funari, U.S. Pat. No. 4,986,044 issued Jan. 22, 1991 discloses a series of jamb assemblies where each consists of a fixed section and an adjustable section. Each fixed section has a series of snap-in guide clips supported on the section. The clips each have a plate-like body, with a leg at each end and an integral cantilever tongue extending generally parallel to, but converging toward, the plate-like body of the clip. In this manner, the tongue is deflected away from the plate-like body. A flange is also provided on the adjustable section, and is received between the cantilever tongue and one of the legs. The tongue of each clip frictionally engages the adjustable section holding it in the adjusted position on the doorjamb.

McKann, et al., U.S. Pat. No. 6,286,274 issued Sep. 11, 2001 describes a coupling for mounting a door frame within an opening. The coupling includes two, substantially identical anchoring clips and two, substantially identical retaining clips. Each anchoring clip includes a base mounting portion and a resilient cantilever portion extending at a non-perpendicular angle from the base mounting portion. The anchoring clips are oriented in opposition to each other. Each retaining clip includes a base mounting section and an angled section extending in a cantilevered manner from its base mounting section. The retaining clips are oriented in a mirror image, so that the cantilever portions of the anchoring clips engage the angled sections of the retaining clips.

Staples, et. al., U.S. Patent Application Publication No. 2004/0060241 published Apr. 1, 2004 describes a single piece, unitary installation aid for holding a door in place relative to a door frame in a pre-hung door assembly, during transportation and installation of the door assembly in a building. The aid includes a wall having an inner surface and an outer surface, and a door clip extending from the wall inner surface. A jamb clip extends from the wall outer surface. The door clip is sized so as to fit over the door, and the jamb clip is sized so as to fit over the jamb. The door clip includes a pair of spaced apart arms extending from the wall inner surface. A finger extends from an end of at least one of the arms, and toward the opposite arm. The jamb clip includes a first leg extending from the wall outer surface, and a second leg extending upwardly from the first leg. The first leg has a length from the wall to the second leg which is slightly greater than the width of the doorjamb.

Loop, U.S. Pat. No. 6,178,717 issued Jan. 30, 2001 discloses a door hanging system utilizing a series of metallic, elongated U-shaped clips which expand the area between the edge of the door opening and the doorjamb. The metallic clips serve to as to support the weight of the door or door jamb during the adjustment phase of installation, and then properly anchor the same once orientation of the door has been achieved.

Gill, U.S. Pat. No. RE45,355 issued Feb. 3, 2015 discloses a door hanger utilizing a triangular shaped jamb mount with small jamb alignment and positioning tabs projecting perpendicular thereto. A wall mounting flange or tab projects laterally therefrom in the opposite direction from said jamb alignment and positioning tabs, and includes alignment notches to assist with alignment and positioning relative to a leveling plumb line placed on the mounting wall.

SUMMARY OF THE INVENTION

The present invention comprises a door hanger bracket, the combination of the door hanger bracket and a door jamb assembly, and the method of using the bracket to hang the door jamb assembly. The door hanger bracket comprises an elongated body configured to provide a wall mounting tab at each end, such that said bracket can be secured to a door jamb as a unitary bracket and provide a wall mounting tab on each wall at each side of the jamb. The bracket also includes a break line such that it can be broken in two and used either on two different jambs or two different locations on the same side of a single jamb or can be located on opposite sides of the same jamb, where the jamb is too wide for the unitary bracket.

These and other objects, advantages and features of the invention will be appreciated by reference to the appended drawings and the Description of the Preferred Embodiments.

BRIEF DESCRIPTION OF THE DRAWINGS

The preferred embodiments of the invention will now be described with respect to the drawings, in which.

DESCRIPTION OF THE PREFERRED EMBODIMENTS

General Description

Figure 1:
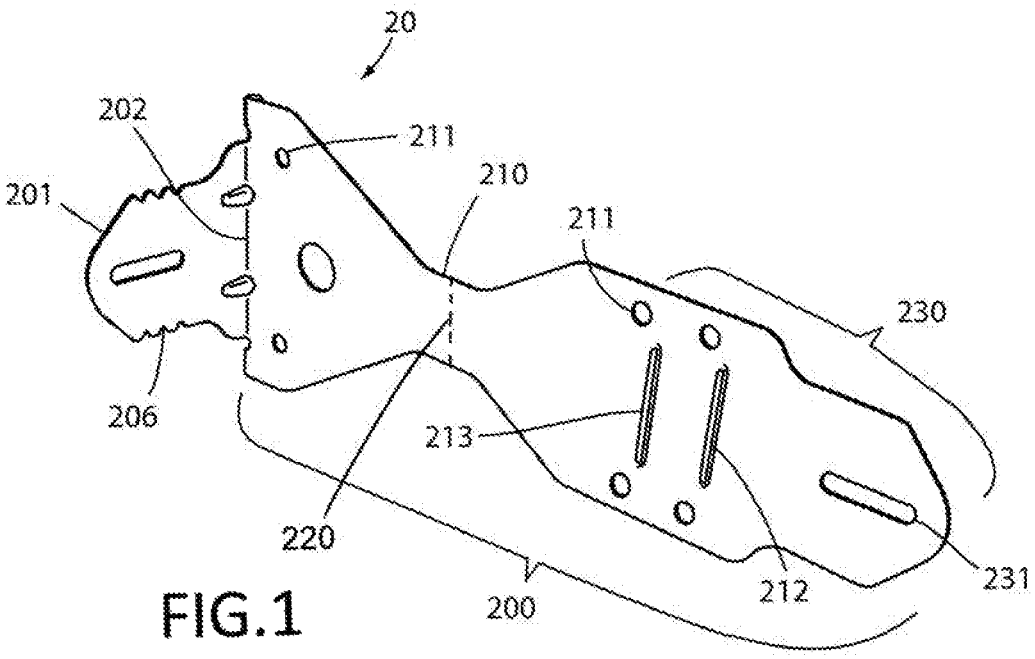
FIG. 1 is an inside perspective view of a preferred embodiment bracket.
Figure 2:
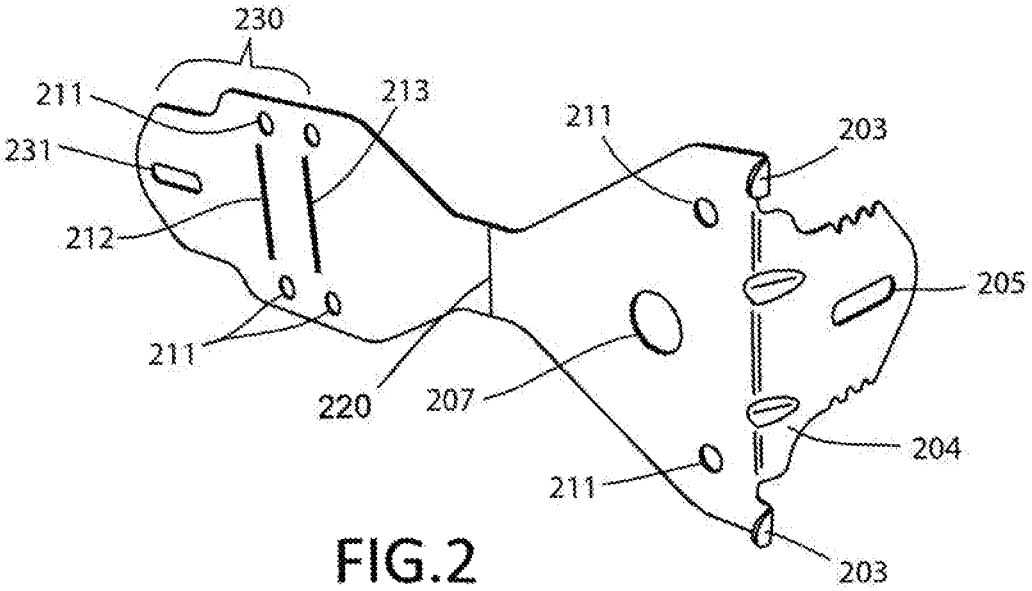
FIG. 2 is an outside perspective view of the preferred embodiment bracket.

In the preferred embodiments, the door hanger bracket 20 comprises an elongated manually bendable body 200 with a first wall mounting tab 201 at one end, projecting laterally from said body (FIGS. 1 and 2). Elongated body 200 extends from said first wall mounting tab 201 for a distance approximately equal to the width of a door jamb, and sufficiently far beyond to provide for forming a second wall mounting tab 230. Thus, elongated body 200 includes a jamb mounting portion 210 and a wall mounting tab portion 230. Body 200 includes at least one bend line 212 extending laterally with respect to the length of said body 200, whereby said body 200 can be manually bent to form said second wall mounting tab 230 (Compare FIGS. 5 and 6).

Figure 1A:
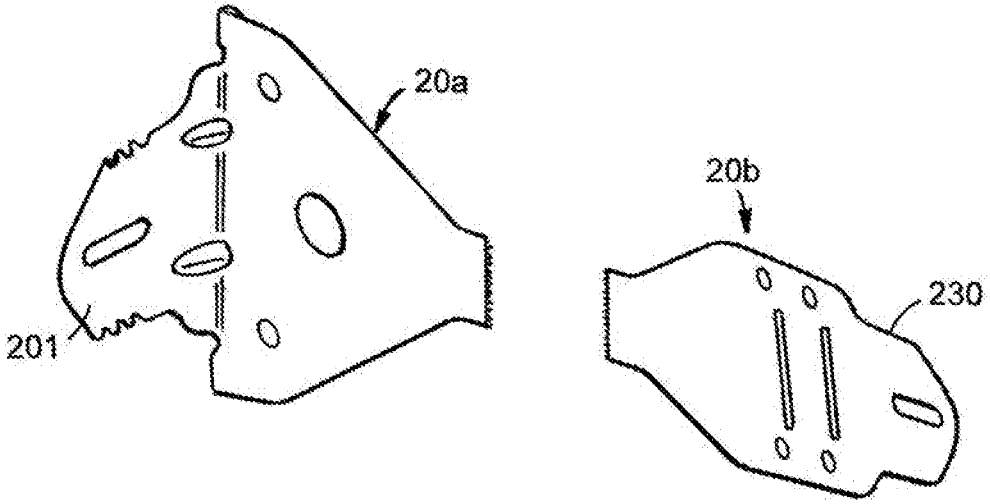
FIG. 1A is the same perspective view as shown in FIG. 1, but with the bracket separated at its break line to create two separate brackets
Figure 2A:
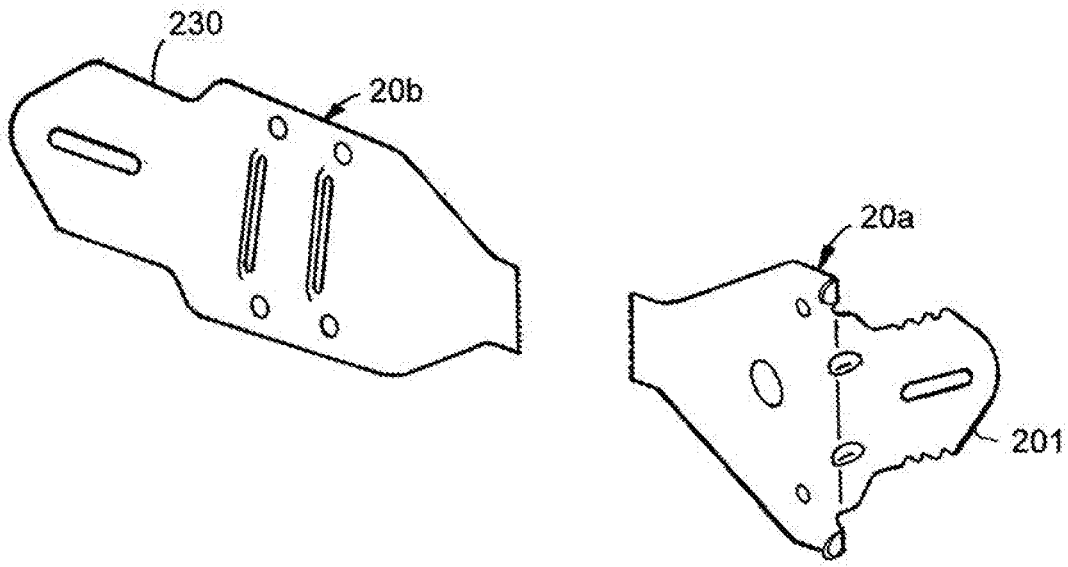
FIG. 2A is the same perspective view as shown in FIG. 2, but with the bracket separated at its break line to create two separate brackets.
Figure 12:
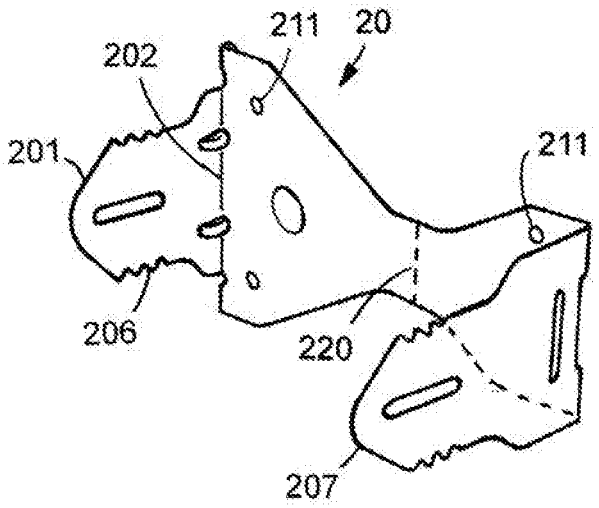
FIG. 12 shows an alternative embodiment bracket that is configured to provide identical pre-formed wall mounting tabs at each end of the bracket.

In this way, bracket 20 is configured to provide a wall mounting tab 201 and 230 at each end of the bracket 20. Further, elongated body 200 includes a break line 220 between tabs 201 and 230 such that it can be separated into two separate mounting brackets 20*a* and 20*b* (See FIGS. 1A and 2A). The two separate brackets 20*a* and 20*b* can be used separately on two separate jambs, or can be used separately on a single jamb, as for example where the jamb is wider than the unitary bracket (see FIG. 3A). The break line is an indentation or "strike" in the body of bracket 20 which is sufficiently deep that it enables one to break bracket 20 into two brackets 20*a* and 20*b* by manually bending bracket 20 at break line 220. FIG. 12 shows a bracket 20*v* which is a variation of bracket 20 in that it is configured to provide identical pre-formed wall mounting tabs 201 at each end of the bracket. When broken at break line 220, it separates into two identical separate brackets 20*a*.

Figure 3:
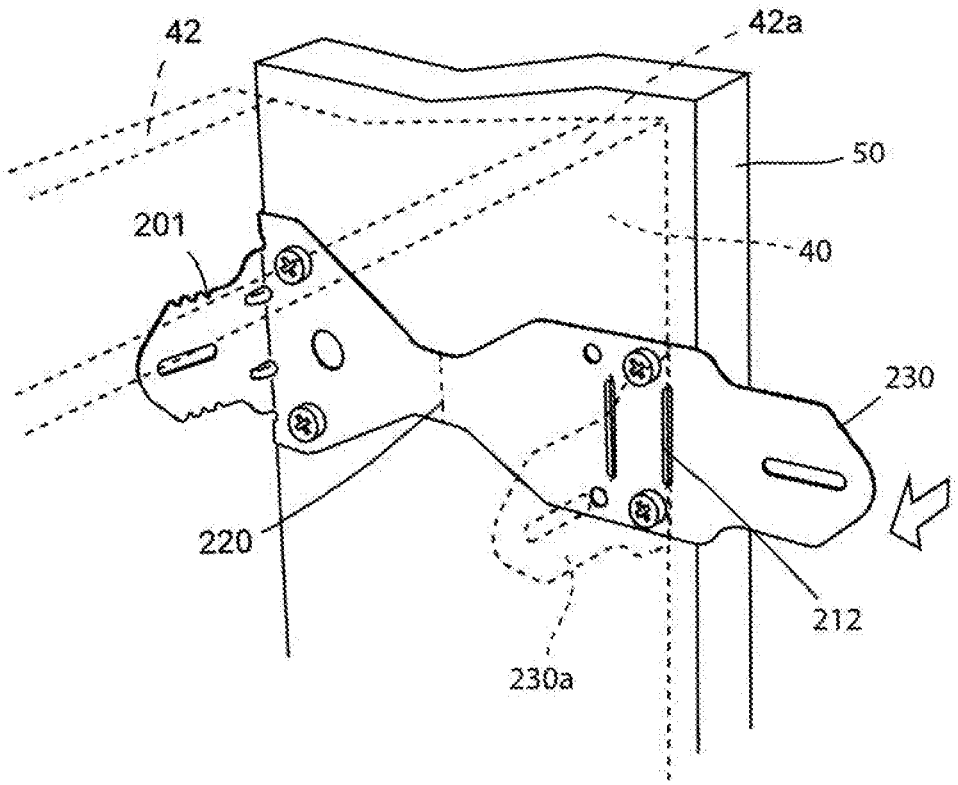
FIG. 3 is a fragmentary perspective view of a door jamb with the unitary bracket secured to the door jamb, where the door will be mounted to a wall having drywall mounted on both inside and outside wall surfaces.
Figure 8:
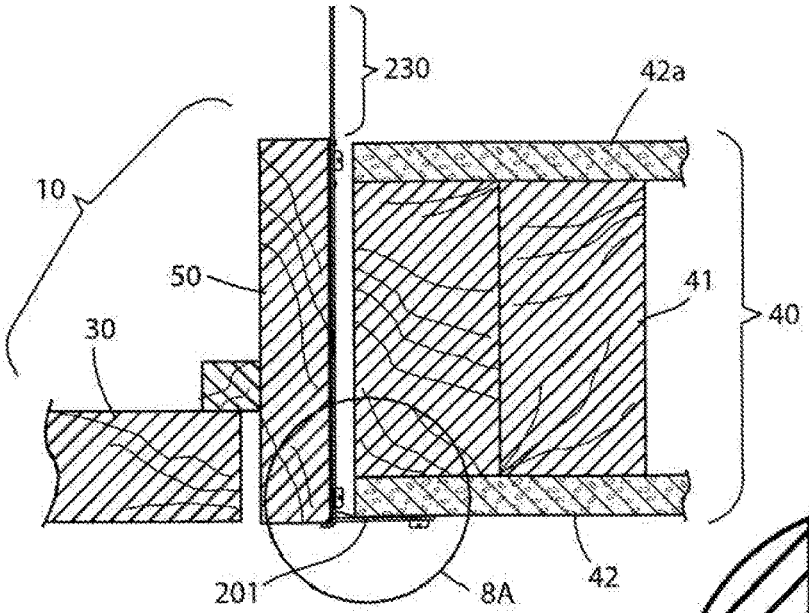
FIG. 8 is the cross section of FIG. 6 showing the front side of the bracket attached to the wall, and the tail side of the bracket unbent.
Figure 9:
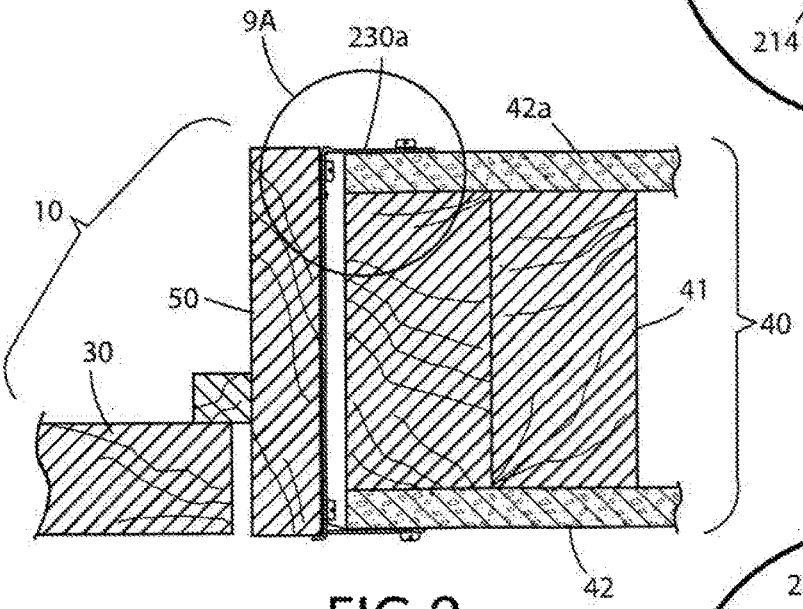
FIG. 9 is the cross section of FIG. 8 showing the front side of the bracket attached to the wall, and the tail side of the bracket bent and attached to the wall, with drywall on both sides.
Figure 10:
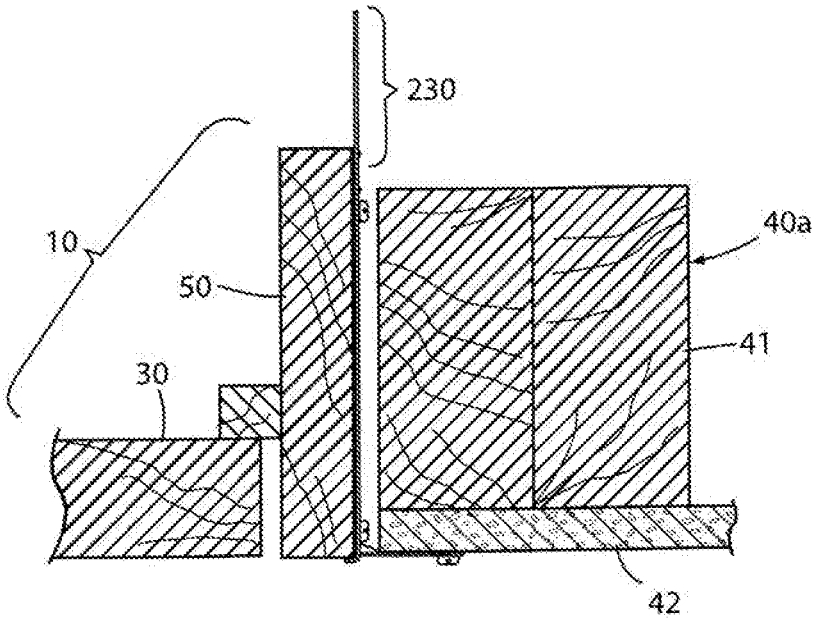
FIG. 10 is the cross section VII-VII of FIG. 6 showing the front side of the bracket attached to the wall, and the tail side of the bracket unbent, with an unfinished wall on the back side.

Preferably, there are two said bend lines 212 and 213 spaced from one another along the length of said body 200. The first bend line 212 is located at a distance from said first wall mounting tab 201 which is approximately equal to the width of a finished wall 40 having dry wall 42 and 42*a* on both sides of said wall 40 (FIG. 3, and compare FIGS. 8 and 9). The second bend line 213 is located at a distance from said first wall mounting tab 201 which is approximately equal to the width of a wall 40*a* having dry wall 42 on only one side of said wall (FIG. 4, and compare FIGS. 9 and 10).

Figure 4:
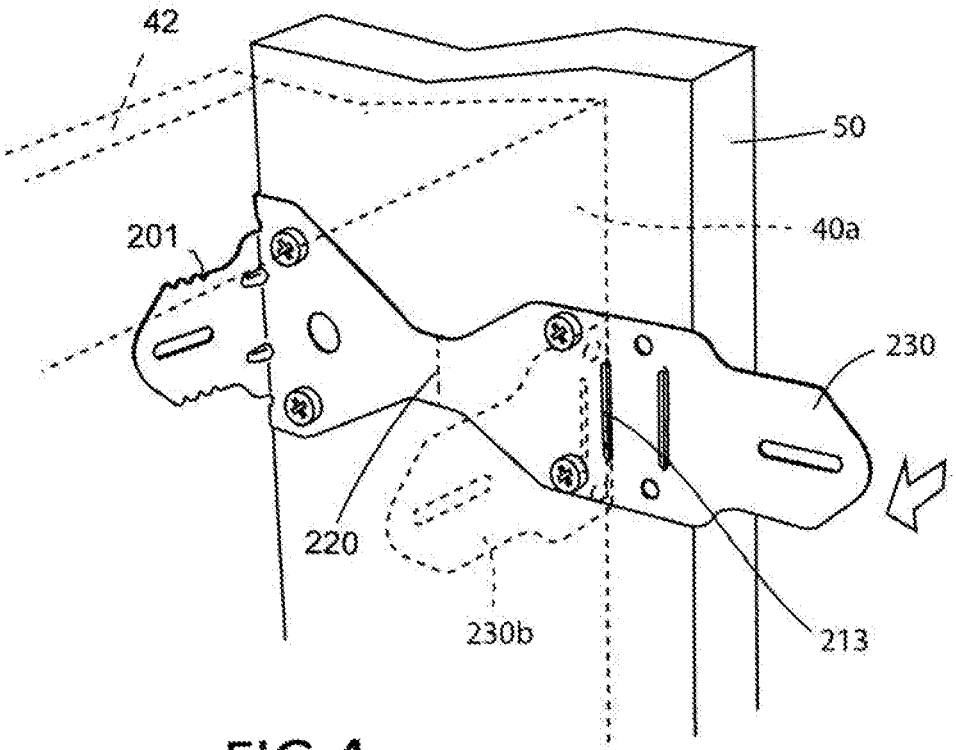
FIG. 4 is a fragmentary perspective view of the door jamb with the bracket secured to the door jamb, where the door will be mounted to a wall having drywall mounted on only one of the wall surfaces.
Figure 5:
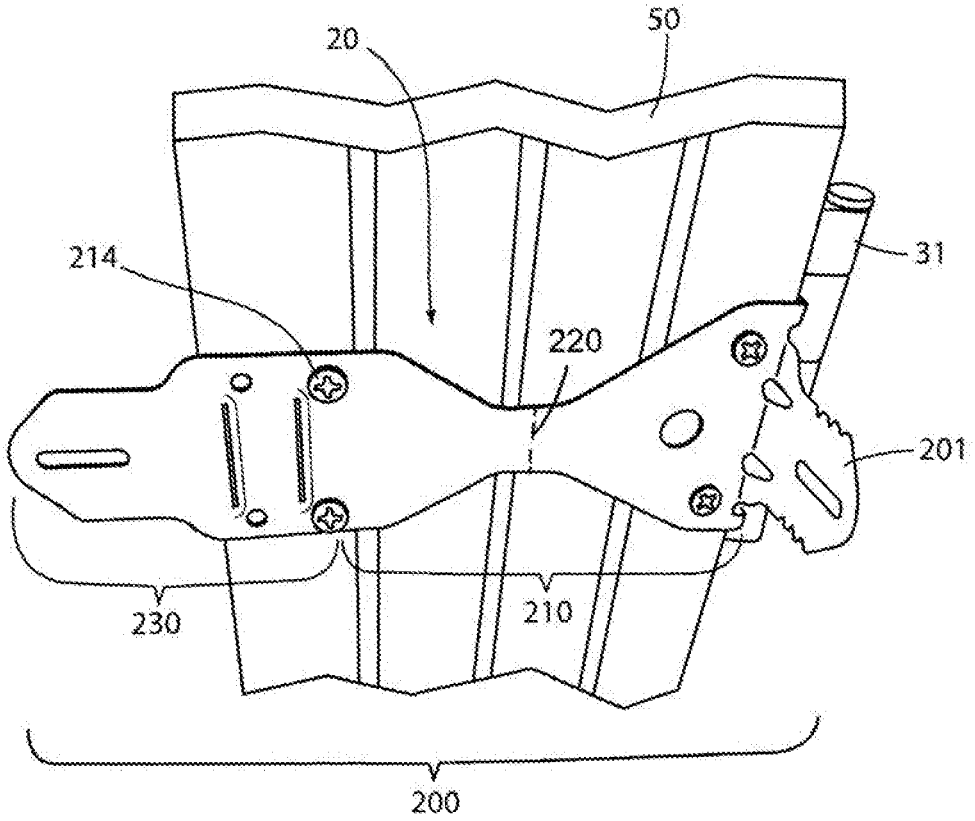
FIG. 5 is a perspective view of the bracket secured to the door jamb.
Figure 6:
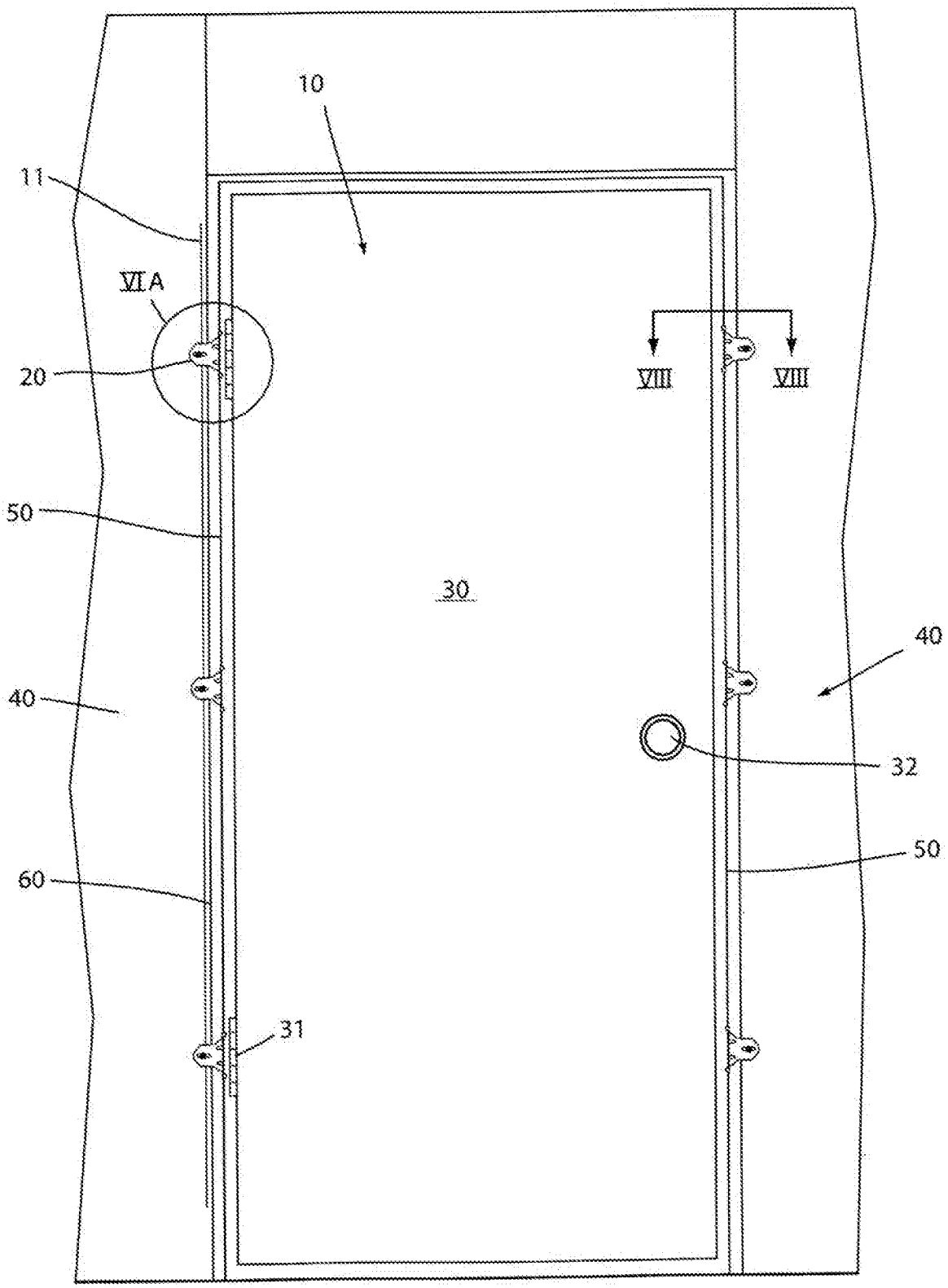
FIG. 6 is a front elevation of the door jamb positioned in the door opening, with three brackets on the hinge side and three brackets on the opening side, with all brackets attached to the wall.
Figure 6A:
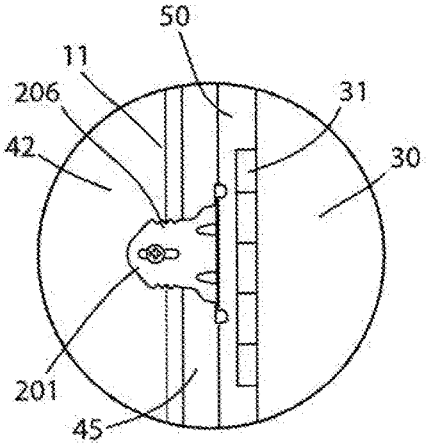
FIG. 6A shows the enlarged area VIA of FIG. 6.
Figure 7:
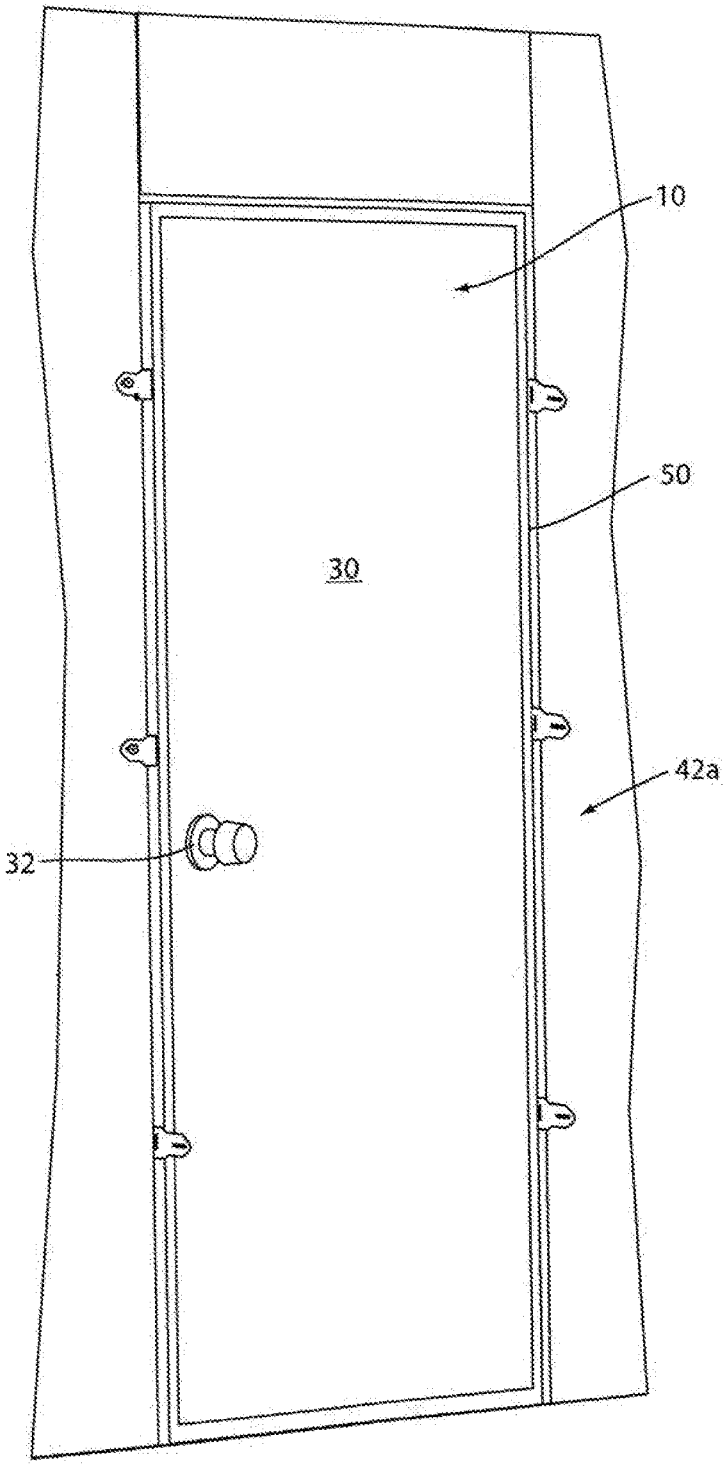
FIG. 7 is a rear elevation of the door jamb positioned in the door opening, with two of the brackets bent and secured to the wall, and the remaining four brackets yet to be bent.
Figure 11:
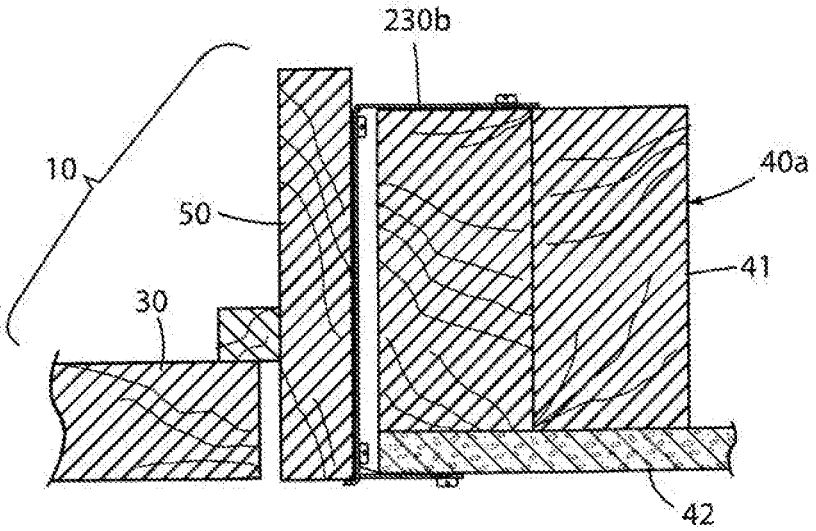
FIG. 11 is the cross section of FIG. 10 showing the front side of the bracket attached to the wall, and the tail side of the bracket bent and attached to the wall, with an unfinished wall on the back side.

In use with a door assembly 10 having a door jamb 50 and a hinged door 30, several brackets 20 are secured to jamb 50 with said first wall mounting tab 201 aligned with the edge of said jamb 50 with the help of positioning and alignment tabs 203, and with said manually formable elongated body 200 extending beyond the opposite edge of said jamb 50 (FIGS. 5, 3 and 4). The jamb and bracket assembly is then positioned in an opening in wall 40 (FIGS. 6 and 7). Wall 40 may be a finished wall as shown in phantom in FIG. 3, having dry wall 42 and 42*a* on both sides (FIGS. 8 and 9). Alternatively, it may be a narrower wall 40*a* as shown in phantom in FIG. 4, having drywall on only one side, and perhaps nothing or only a thin covering on the other side (FIGS. 10 and 11). If it is a wall 40 having dry wall on both sides, the extending portion 230 of elongated body 200 is manually bent at first bend line 212, to form a second wall mounting tab 230*a*. Tab 230*a* is then secured to wall 40 through the drywall 42*a* (FIGS. 8 and 9). If it is a wall 40*a* having drywall on only one side, the extending portion 230*a* is bent at second bend line 213, to form a longer second wall mounting tab 230*b*. Tab 230*b* is then secured to the wall stud 41 (FIGS. 10 and 11).

Figure 3A:
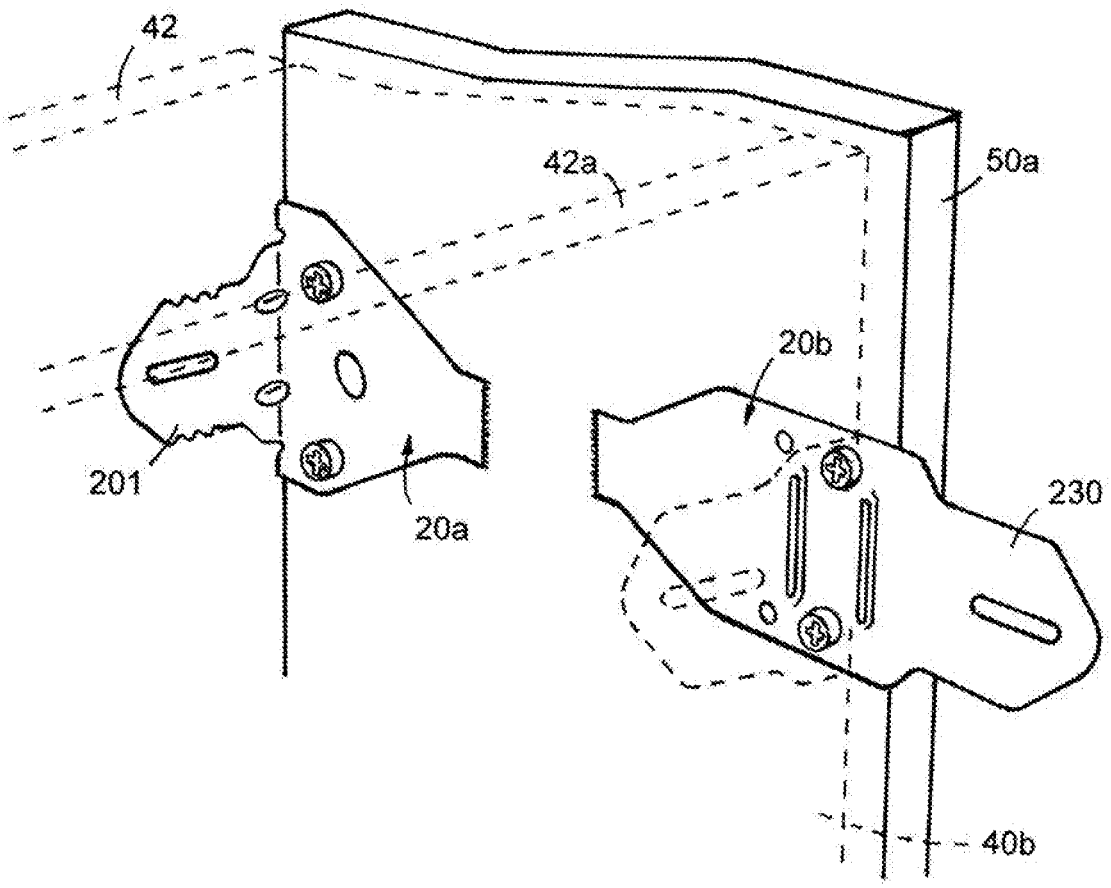
FIG. 3A is the same perspective view as FIG. 3, except the door jamb and the associated wall are both wider, and the bracket has been separated at its break line to create two separate brackets for mounting in the door jamb.

In FIG. 3A, brackets 20 are used on a wall 40*b* which is wider than the wall tab ends of bracket 20. Accordingly, bracket 20 has been broken by bending at break line 220 to create two brackets 20*a* and 20*b* which can be used on the opposite sides of the wider door jamb 50*a* required for use on wider wall 40*b*.

Preferably, brackets 20 are made of a bendable metal such as steel, galvanized steel, aluminum or other reasonable materials. The thickness of the bracket material depends on the strength of the material selected, and the amount of security required for the finished door assembly installation. A range of thickness from 0.020-0.125 inches can be used for most bendable materials. A preferred metal is a galvanized and heat treated steel, commonly known as Galvaneal, with a thickness of about 0.030 inches. Preferably, the metal is formed into manually formable bracket 20 by stamping. The break line 220 is formed in bracket 20 during the stamping process.

Terminology and Parts

The terms "lateral" as used herein means "generally perpendicular to." Similarly the term "perpendicular" as used herein means "generally perpendicular," or "essentially perpendicular." The term "approximately equal" is used to allow for limited variation from precise equality which is not sufficient to interfered with the intended functionality of the "approximately equal" components or features of door hanger bracket 20. The components discussed herein are numbered as shown below.

10—Door Assembly
11—Plumb Line
20—Door Hanger Bracket
20*a* and 20*b*—Door Hanger brackets formed by breaking bracket 20 in half at break line 220
20*v*—Door Hanger Bracket with identical wall tabs 20*a* at each end.
30—Door
31—Door Hinge
32—Door Latch
40—Wall—standard thickness
40*a*—Wall—narrower thickness
41—Wall Stud
42—First side Wall Surfacing Material (drywall)
42*a*—second side Wall Surfacing Material (drywall)
44—Wall mounting screw
50—Door Jamb
60—Rough Wall Opening
20—Door Hanger Bracket
200—Manually bendable elongated body, sometimes referred to herein as main body
201—Preformed first wall mounting tab
202—Preformed corner
203—Preformed bracket positioning tab(s)
204—Preformed gussets
205—First wall mounting slot
206—wall alignment marks
207—Hinge Screw Compensation Hole
220—Break line
210—jamb mounting portion of elongated body 200
211—Door jamb mounting holes
212—Preformed bend line/notch(s)
213 Second preformed bend line/notch
214—Jamb mounting screw
230—Second wall mounting tab forming portion of elongated body 200
230*a*—manually bent second wall mounting tab for a full width wall
230*b*—manually bent second wall mounting tab for narrow wall
231—second wall mounting slot
234—in-situ gusset
25—Single wall door hanger bracket
210*a*—triangular jamb mounting body Bend Lines and Break Line In bracket 20, wall mounting tab 201 is preformed into the bracket, while wall mounting tab 230 at the other end of bracket 20 is formed in situ at the point of use, by bending the bracket at either bend line 212 or bend line 213. The bend line features 212 and 213 can be formed as narrow slots, grooves, or a series of drilled holes though it is most preferable to stamp the bend lines into metal main body 200 to form elongated narrow notches, which might also be described as grooves (FIGS. 1 and 2). The elongated narrow notch partially penetrates the surface of the metal on the jamb facing surface of said main body, and the metal to either side of the penetrating portion of the notch slopes downwardly slightly to the penetrating portion. Preferably, the notches 212/213 are stamped into the jamb mounting side of main body 200, to project slightly from the surface of the wall facing side of main body 200. Accordingly, one is bending main body 200 in the same direction the notch 212 or 213 projects. One would think that the notches 212 and 213 should be made in the wall facing side of main body 200, to provide bend relief on the inside corner of the manual bend which forms said second wall mounting tab 230. We have found surprisingly, that by forming bend lines 212 and 213 to project into the inside corner to be formed, the bending of main body 200 is easier and forms a sharper, tighter radius bend at the corner of formed tab 230 and main body 200.

Figure 9A:
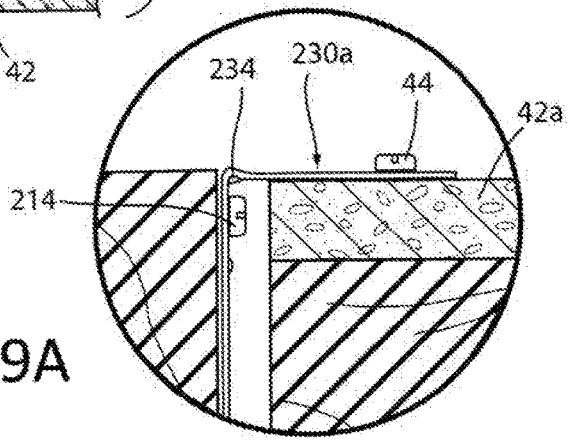
FIG. 9A is the enlarged area of FIG. 9.

Also, preferably, bend lines 212 and 213 extend only partially across the lateral width of main body 200, stopping short of the side edges of main body 200. Further, it has been discovered by locating the door jamb mounting holes 211 and the heads of the jamb mounting screws 214 near the bend line notch 212/213 provides a stress relief pattern extending from each end of the bend line, which upon manual bending forms an in-situ gusset 234 above and below the bend line (FIG. 9A). This improves the stability of the second wall mounting tab 230 when bent and attached to the wall.

Typically, on a bracket with a width of 1.5-2.0 inches the optimum bend line notch has a length of ½ to ⅞ inches, with length of ¾ inch most preferred. In accordance with this notch size, the jamb mounting holes 211, which are typically 1/16 to ¼ inch in diameter with 3/16" diameter preferred, would be set inward from the bend lines 212 and 213 notch placement about 1/16 to ⅛ inch, and approximately ⅛-¼ inch outside of the end of the bend line notch 212 and 213.

Break line 220 is formed during the stamping process and extends all the way across the width of jamb mounting portion 210 of bracket 20. It penetrates the surface of jamb mounting portion 210, but preferably does not create a protrusion on the other side, such that jamb mounting portion 210 is thinner at break line 220. In the preferred embodiment shown, break line 220 is struck into the jamb facing surface of jamb mounting portion 210. Thus, break line 220 is shown as a solid line 220 in FIG. 2, but as a hidden line FIGS. 1, 3, 4, 5, and 12. Preferably it is located at the narrowest width of the bow tie shaped jamb mounting portion 210. It penetrates into jamb mounting portion 210 to a depth sufficient that bracket 20 breaks in two when bent at break line 220. This will typically be from about 25-90% of the thickness of elongated body 200.

Pre-Formed Wall Mounting Tab

At least one smaller bracket positioning tab(s) 203 is formed at the first wall mounting tab 201 end of main body 200 essentially parallel to and projecting in the opposite direction from said first wall mounting tab to enhance the alignment and positioning of said bracket to said door jamb (FIG. 2). Preferably, one of said tabs 203 is located above and one below said first wall mounting tab 201.

Figure 8A:
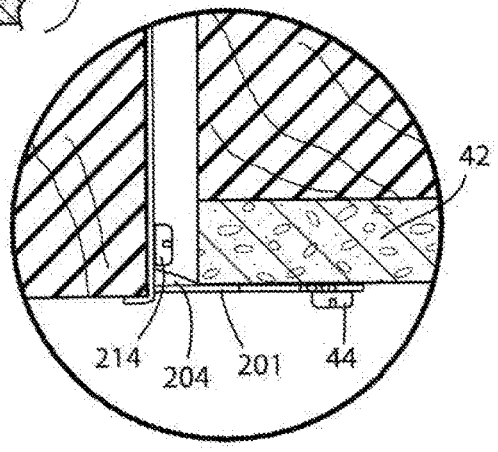
FIG. 8A is the enlarged area of FIG. 8.

Preferably at least one, preferably two preformed gussets 204 are impressed into said first wall mounting tab 201 to project into the inside corner of the junction between first wall mounting tab 201 and main body 200. Said gussets 204 extend from said inside corner into said wall mounting tab 201 to a distance which is just sufficient to leave a space 45 between the end of the wall 40 and face of jamb 50, which will accommodate the heads of the jamb mounting screws 214 (FIG. 8A). Typically, this distance is ⅛ to ⅜ of an inch, and preferably ¼ of an inch. The gussets are impressed inwardly into said tab 201 to a depth of 1/16-¼ of an inch, with a depth of approximately ⅛$^{th}$ inch most preferred. The width of the gusset 204 is typically ⅛ to ¼ of an inch at their widest point, depending on the thickness of the metal used and the spacing of the gussets. It is understood that the number, size, and specific location of the pre-formed gusset design can be reasonably altered to accommodate specialized bracket designs depending on the strength and thickness of the bracket material being used, as well as accommodations required for unique door assembly requirements.

In addition to improving the strength and quality of the finished door assembly, said gussets also make the packaged brackets stronger and more durable during normal shipping and handling associated with transportation and construction site applications which tend to bend or straighten many preformed features.

In alternative embodiment bracket 20*v* shown in FIG. 12, both ends of bracket 20*v* comprise pre-formed wall mounting tabs 201.

Jamb Mounting Body Design

The thickness and width of the door hanger bracket 20 can be adjusted in a variety of manners to adjust for the specific door assembly to be installed. The dimensions provided above typical for those used with a standard interior door assembly installation. It has been determined for this standard inside door application that several irregular shape profiles can be used on the jamb mounting portion of the bracket to optimize manufacturing efficiencies without compromising the strength and integrity of bracket 20. In the preferred embodiment, jamb mounting portion 210 of main body 200 is shaped in a bow tie fashion to provide sufficient strength at both the first wall tab 201 and the manually formed second wall tab 230, while tapering down in the middle portion of main body to minimize material utilization. The bow tie shape also facilitates stamping multiple brackets out of a sheet of metal in "nesting fashion" optimizing material utilization.

Door Assembly Installation Process

Turning to the drawings, a standard indoor door assembly 10 (shown in FIG. 6) is installed in a rough door opening 60 of the wall 40. A plumb line 11 is scribed on the hinge side 42 of first wall side 40 adjacent to the intended hinge 31 side of the door jamb 50. Plumb line 11 extends from above the desired location of the top bracket 20 and continuing to below the desired location of the bottom door mounting bracket 20. The plumb line 11 is typically located on wall 40 approximately ¼-1 inch away from the edge of the rough door opening 60 such that the preformed wall mounting tab 201 will cover a portion of the plumb line 11 during the installation of the door assembly. The proximity of the plumb line 11 to the preformed wall mounting tab 201 is then such that at least one of the wall alignment marks 206 overlays the plumb line and provides the means for the installer to have a ready reference for properly leveling the door assembly during installation.

Upon locating the hinge side of door assembly, the installer can locate the bracket 20 on the hinge 31 side of the door jamb 50 with the first wall tab 201 located on the first wall 40 side of the opening with said tab extending away from the door jamb. Using the preformed bracket positioning tabs 203 the bracket location can be easily set such that the bracket is quickly located in close proximity to the door hinge 31 and essentially perpendicular with the hinge side door jamb which provides for minimal tab protrusion challenges during final trim assembly. If additional security is desired for the finished door assembly, the bracket 20 can be aligned with the hinge 31 such that one of the hinge screws aligns with the hinge screw compensation hole 207 on the bracket. This allows for the subsequent installation of an extra-long screw to be driven thru the jamb 40 and bracket 20 into the stud wall 41.

At this point the installer can drive in 2 or more, and preferably 4 jamb mounting screws 214 thru the jamb mounting holes 211 in the bracket and into the door jamb 50. The same process is completed for a second bracket 20 in close proximity to the remaining hinge 31 of the door assembly. If added security or strength is needed additional brackets may be added to the door flange at this time, with spacing of additional brackets determined to provide the best stress distribution possible.

In situations where separate brackets 20*a* and 20*b* are desired or required, as for example where wall 40*b* and its associated jamb 50*a* are wider than the typical wall, bracket 20 or 20*v* is broken by bending at break line 220. This yields separate brackets 20*a* and 20*b* can be separately applied to the same or different jambs, or can be used on opposite sides of a larger jamb such as jamb 50*a*, as shown in FIG. 3A.

Conclusion

It is understood that several bracket widths and material variations can be selected depending upon the door assembly requirements involved. These may require adjustments to the dimensional layout provided above, and the basis of this example is provided for a preferred bracket design for a standard interior door installation with standard material sizes involved.

It is further understood that the number and spacing of the bend lines may vary for custom or non-standard door assembly designs and the specific example provided should not be considered limiting to this invention. For example, it may be desirable to have 3 or 4 bend lines established for customized door assemblies used in specialized clean room operations where standard ½-inch drywall is not commonly used and specialized fiberglass or plastic wall coverings, and other various combinations can create a wider variety of finished wall thickness requirements which would benefit from adding additional bend line features.

Of course, it is understood that this is a preferred embodiment, and that various changes and alterations can be made without departing from the spirit and scope of the invention as set forth in the appended claims.

The invention claimed is:

1. A door hanger bracket comprising: a flat elongated body having an irregular shape, said elongated body having lateral width with side edges circumscribing said lateral width: said elongated body being configured to provide a wall mounting tab at each end, such that said bracket can be secured to a doorjamb as a unitary bracket and provide a wall mounting tab on each wall at each side of the door jamb;

a first of said wall mounting tabs being preformed to extend laterally from said elongated body; said elongated body extending away from said preformed first wall mounting tab for a distance approximately equal to the width of a door iamb, and sufficiently far beyond to provide for forming a second wall mounting tab: said elongated body including at least one bend line extending laterally with respect to the length of said elongated body, whereby said elongated body can be manually bent at said at least one bend line to form said second wall mounting tab to extend laterally from said elongated body for attaching to a wall adjacent a door opening;

a break line in said elongated body extending partially through the thickness of said elongated body and from one of said side edges to the other, such that said bracket can be broken in two and used separately either on two different door jambs or two different locations on the same side of a single door iamb, or can be located on opposite sides of the same door iamb, where the door jamb is too wide for said unitary bracket.

2. The door hanger bracket of claim 1 in which said elongated body has a bow tie shaped door iamb mounting portion such that it is narrower in the mid portion thereof, said break line being located at said narrower mid-portion of said door jamb mounting portion.

3. The door hanger bracket of claim 1 which said at least one bend line comprises first and second bend lines spaced from one another along the length of said manually bendable elongated body; said first bend line being located at a distance from said first wall mounting tab which is approximately equal to the width of a finished wall having dry wall on both sides of said wall; said second bend line being located at a distance from said first wall mounting tab which is approximately equal to the width of a wall having dry wall on only one side of said wall.

4. The door hanger bracket of claim 3 in which each said bend line extends only partially across said lateral width of said elongated body, stopping short of said side edges of said elongated body; each said at bend line partially penetrating the surface of said elongated body; said elongated body having a door jamb facing surface which will face said door jamb when said bracket is secured to said door jamb, and a wall facing surface will face said wall when an assembled door hanger bracket and door jamb are positioned in an opening in said wall; said at least one bend line being stamped into said door jamb facing surface of said elongated body to form an elongated narrow notch; said elongated narrow notch projecting slightly from said wall facing surface of elongated body, whereby when one is bending said elongated body to form said second wall mounting tab, one is bending in the same direction into which said notch projects.

5. The combination of a plurality of door hanger brackets attached to a pre-hung door assembly comprising a door jamb, a door, and hinges joining said door to said jamb; each of said door hanger brackets being the bracket of claim 1.

6. A method for securing a pre-hung door having a door, a jamb having first and second spaced sides and a top cross piece, each having front edges aligned in a vertical plane and back edges aligned in a vertical plane and wall opening facing surfaces between said front and back edges, and hinges securing said door to said first side of said jamb, said method comprising;

securing a plurality of door hanger brackets to said hinged first side jamb of said prehung door assembly;

each said secured door hanger brackets comprising: a flat elongated body having an irregular shape, said elongated body having lateral width with side edges circumscribing said lateral width; said elongated body being configured to provide a wall mounting tab at each end, such that said bracket can be secured to a door jamb as a unitary bracket and provide a wall mounting tab on each wall at each side of the jamb, a first of said wall mounting tabs being preformed to extend laterally from said elongated body; said elongated body extending away from said preformed first wall mounting tab a for a distance approximately equal to the width of a door iamb, and sufficiently far beyond to provide for fanning a second wall mounting tab; said elongated body including at least one bend line extending laterally with respect to the length of said elongated body, whereby said elongated body can be manually bent at said at least one bend line to form said second wall mounting tab to extend laterally from said elongated body for attaching to a wall adjacent a door opening; a break line in said elongated body extending partially through the thickness of said elongated body and from one of said side edges to the other, such that said bracket can be broken in two and used separately either on two different door iambs or two different locations on the same side of a single door jamb, or can be located on opposite sides of the same door iamb, where the door jamb is too wide for said unitary bracket; said step of securing a plurality of door hanger brackets to said hinged first side iamb of said pre-hung door assembly comprising aligning said preformed wall mounting tab with said front edge of said hinged first side iamb and securing said elongated body to said wall opening facing side of said first, side jamb;

positioning said pre-hung door assembly with said secured door hanger brackets in a door opening of a wall having first and second wall sides; securing said wall mounting tabs of said door hanger brackets to their adjacent first wall side; bending said elongated body at said bend line towards said second wall side to form a second wall mounting tab in situ; securing said second wall mounting tabs to said second wall side.

* * * * *